US011583993B2

(12) United States Patent
Rastegar et al.

(10) Patent No.: US 11,583,993 B2
(45) Date of Patent: Feb. 21, 2023

(54) ANTI-KICKBACK AXE

(71) Applicant: Omnitek Partners LLC, Ronkonkoma, NY (US)

(72) Inventors: Jahangir S Rastegar, Stony Brook, NY (US); Christopher Chodkowski, Lindenhurst, NY (US); Thomas Spinelli, Northport, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 315 days.

(21) Appl. No.: 16/859,964

(22) Filed: Apr. 27, 2020

(65) Prior Publication Data

US 2020/0338712 A1 Oct. 29, 2020

Related U.S. Application Data

(60) Provisional application No. 62/840,319, filed on Apr. 29, 2019.

(51) Int. Cl.

| | |
|---|---|
| ***B25G 1/01*** | (2006.01) |
| ***B25G 1/04*** | (2006.01) |
| ***B26B 23/00*** | (2006.01) |

(52) U.S. Cl.

CPC ..... *B25G 1/01* (2013.01); *B25G 1/04* (2013.01); *B26B 23/00* (2013.01)

(58) Field of Classification Search

CPC ..... B25G 1/01; B25G 1/02; B26B 23/00

See application file for complete search history.

(56) References Cited

U.S. PATENT DOCUMENTS

| | | | | |
|---|---|---|---|---|
| 1,794,008 A * | 2/1931 | Forbes | B25G 1/01 | 81/22 |
| 2,603,260 A * | 7/1952 | Floren | B25G 1/01 | 81/22 |
| 4,300,606 A * | 11/1981 | Branson | B26B 23/00 | 30/308.1 |
| 8,925,207 B2 * | 1/2015 | Kama | B26B 23/00 | 144/195.7 |
| 10,464,198 B1 * | 11/2019 | Steidtmann | B25G 3/30 | |

FOREIGN PATENT DOCUMENTS

| | | | |
|---|---|---|---|
| EP | 1283092 A1 * | 2/2003 | B25G 1/01 |

* cited by examiner

*Primary Examiner* — David B. Thomas

(57) ABSTRACT

An axe including: a lever axe head having a cutting edge, the lever axe head being configured to generate a torque and to rotate upon one of the cutting edge striking a material and the cutting edge penetrating a predetermined distance into the material; a handle having a first portion attached to the lever axe head and a second portion to be gripped by a user; and one or more springs disposed between the first portion of the handle and the lever axe head for biasing the lever axe head and handle relative to each other such that first portion of the handle and the lever axe head rotate relative to each other to absorb at least a portion of the generated torque from being transmitted to the user.

18 Claims, 9 Drawing Sheets

ANTI-KICKBACK AXE

CROSS-REFERENCE TO RELATED APPLICATION

This application claims the benefit of U.S. Provisional Application No. 62/840,319, filed on Apr. 29, 2019, the entire contents of which is incorporated herein by reference.

BACKGROUND OF THE INVENTION

1. Field of the Invention

The present invention relates generally to axes, and more particularly, to lever axes and even more particularly, to an anti-kickback lever axe.

2. Prior Art

U.S. Pat. No. 8,925,207 discloses a lever axe. Although lever axes of the type disclosed in U.S. Pat. No. 8,925,207 have advantages over conventional axes, a problem with such lever axe is that when you strike something, such as wood with it, it twists the wrist of the user and can cause considerable discomfort and even injury to the user.

That is, a moment generated by the offset mass of the axe head in U.S. Pat. No. 8,925,207 is resisted by the user's grip (effectively, the user's wrist but also possibly the user's hand, arm and shoulder) and therefore, transferred to, and absorbed by, the user's wrist. Thereby, a certain amount of effective moment (torque) that would have been applied to the splitting action of the wood is reduced, and a very high shock toque loading is applied to the user's wrist (hand and arm), that can cause injury over time.

SUMMARY

By eliminating or reducing the portion of the mechanical energy absorbed by the user, the user is spared discomfort and possible injury. Furthermore, more mechanical energy becomes available for splitting the wood, thereby the axe becomes more effective in splitting wood (while reducing discomfort and injury to the user).

In the disclosed embodiments, a spring element, such as a torsion spring, is disposed on one or more of between the axe head and the handle, a holding jacket disposed over the handle and first and second handle parts. Such configuration minimizes the twisting torque on the wrist and also increases effectiveness of the axe to split wood since part of the mechanical energy is not absorbed by the user wrist.

Accordingly, a lever axe is provided. The lever axe comprising a lever axe head having a cutting edge, the lever axe head being configured to generate a torque and to rotate upon one of the cutting edge striking a material and the cutting edge penetrating a predetermined distance into the material; a handle having a first portion attached to the lever axe head and a second portion to be gripped by a user; and one or more springs disposed between the first portion of the handle and the lever axe head for biasing the lever axe head and handle relative to each other such that first portion of the handle and the lever axe head rotate relative to each other to absorb at least a portion of the generated torque from being transmitted to the user.

The handle can have a single piece construction where the first portion of the handle comprises a first end of the handle.

The handle can comprise a first handle having the first portion and a handle jacket having the second portion, the handle jacket being rotatably disposed relative to the first handle and the handle jacket being disposed over an outer surface of the first handle.

The handle can comprise a first handle having the first portion and a second handle having the second portion, the second handle being rotatably disposed relative to the first handle and the first and second handles being arranged in series from the lever axe head.

The lever axe head can be provided offset from the handle to generate the torque.

The lever axe head can be provided with an offset mass for offsetting a center of mass from the handle to generate the torque.

The lever axe head can be provided with a depth penetrating stop asymmetrically formed relative to the handle to generate the torque.

The lever axe head can be provided with a depth penetrating stop symmetrically formed relative to the handle.

The one or more springs can comprise a torsion spring having a first end fixed to the first portion of the handle and a second end at least indirectly fixed to the lever axe head.

The one or more springs can comprise an elastomer disposed in a space between the first portion of the handle and the lever axe head such that the elastomer is fixed to the first portion of the handle and at least indirectly fixed to the lever axe head.

Also provided is an axe comprising: a lever axe head having a cutting edge, the lever axe head being configured to generate a torque and to rotate upon one of the cutting edge striking a material and the cutting edge penetrating a predetermined distance into the material; and a handle having a first portion attached to the lever axe head and a second portion to be gripped by a user; wherein the lever axe head being provided with an offset mass for offsetting a center of mass from the handle to generate the torque.

The axe can further comprise one or more springs disposed between the first portion of the handle and the lever axe head for biasing the lever axe head and handle relative to each other such that first portion of the handle and the lever axe head rotate relative to each other to absorb at least a portion of the generated torque from being transmitted to the user.

The handle can have a single piece construction where the first portion of the handle comprises a first end of the handle.

The handle can comprise a first handle having the first portion and a handle jacket having the second portion, the handle jacket being rotatably disposed relative to the first handle and the handle jacket being disposed over an outer surface of the first handle.

The handle can comprise a first handle having the first portion and a second handle having the second portion, the second handle being rotatably disposed relative to the first handle and the first and second handles being arranged in series from the lever axe head.

Still further provided is an axe comprising: a lever axe head having a cutting edge, the lever axe head being configured to generate a torque and to rotate upon one of the cutting edge striking a material and the cutting edge penetrating a predetermined distance into the material; and a handle having a first portion attached to the lever axe head and a second portion to be gripped by a user; wherein the lever axe head being provided with a depth penetrating stop asymmetrically formed relative to the handle to generate the torque.

The axe can further comprise one or more springs disposed between the first portion of the handle and the lever axe head for biasing the lever axe head and handle relative to each other such that first portion of the handle and the lever axe head rotate relative to each other to absorb at least a portion of the generated torque from being transmitted to the user.

The handle can have a single piece construction and the first portion of the handle comprises a first end of the handle.

The handle can comprise a first handle having the first portion and a handle jacket having the second portion, the handle jacket being rotatably disposed relative to the first handle and the handle jacket being disposed over an outer surface of the first handle.

The handle can comprise a first handle having the first portion and a second handle having the second portion, the second handle being rotatably disposed relative to the first handle and the first and second handles being arranged in series from the lever axe head.

Still further provided is a method for reducing or eliminating a generated torque by a lever axe from being transmitted to, and absorbed by, a user's wrist.

BRIEF DESCRIPTION OF THE DRAWINGS

These and other features, aspects, and advantages of the apparatus and methods will become better understood with regard to the following description, appended claims, and accompanying drawings where:

DETAILED DESCRIPTION

Although the embodiments disclosed below are applicable to all types of axes, it is particularly applicable to a lever type axe and to minimize or eliminate twisting of the user's wrist when the axe strikes a material for chopping.

Figure 1:
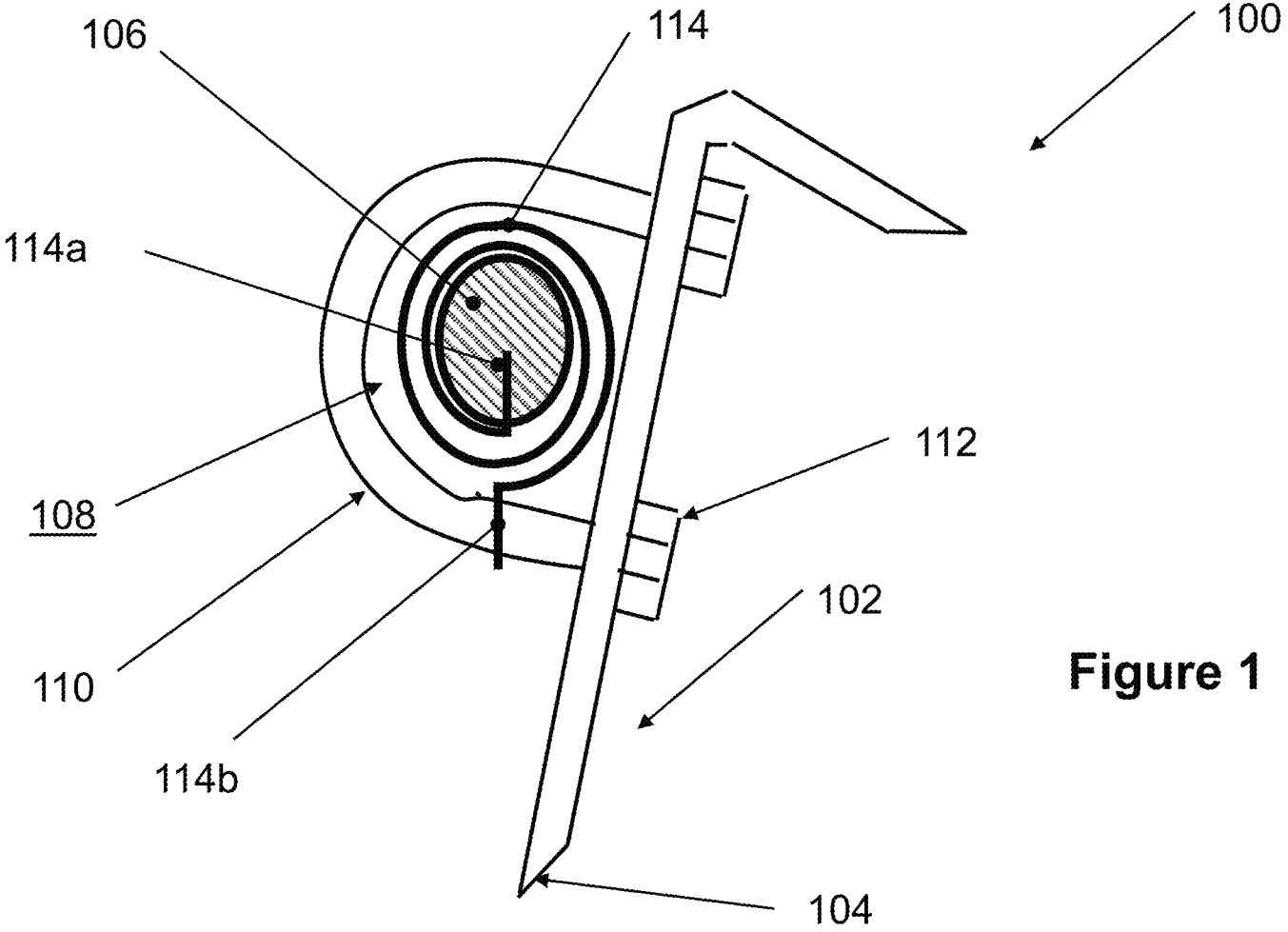
FIG. 1 illustrates a top view of an embodiment of an axe.
Figure 2:
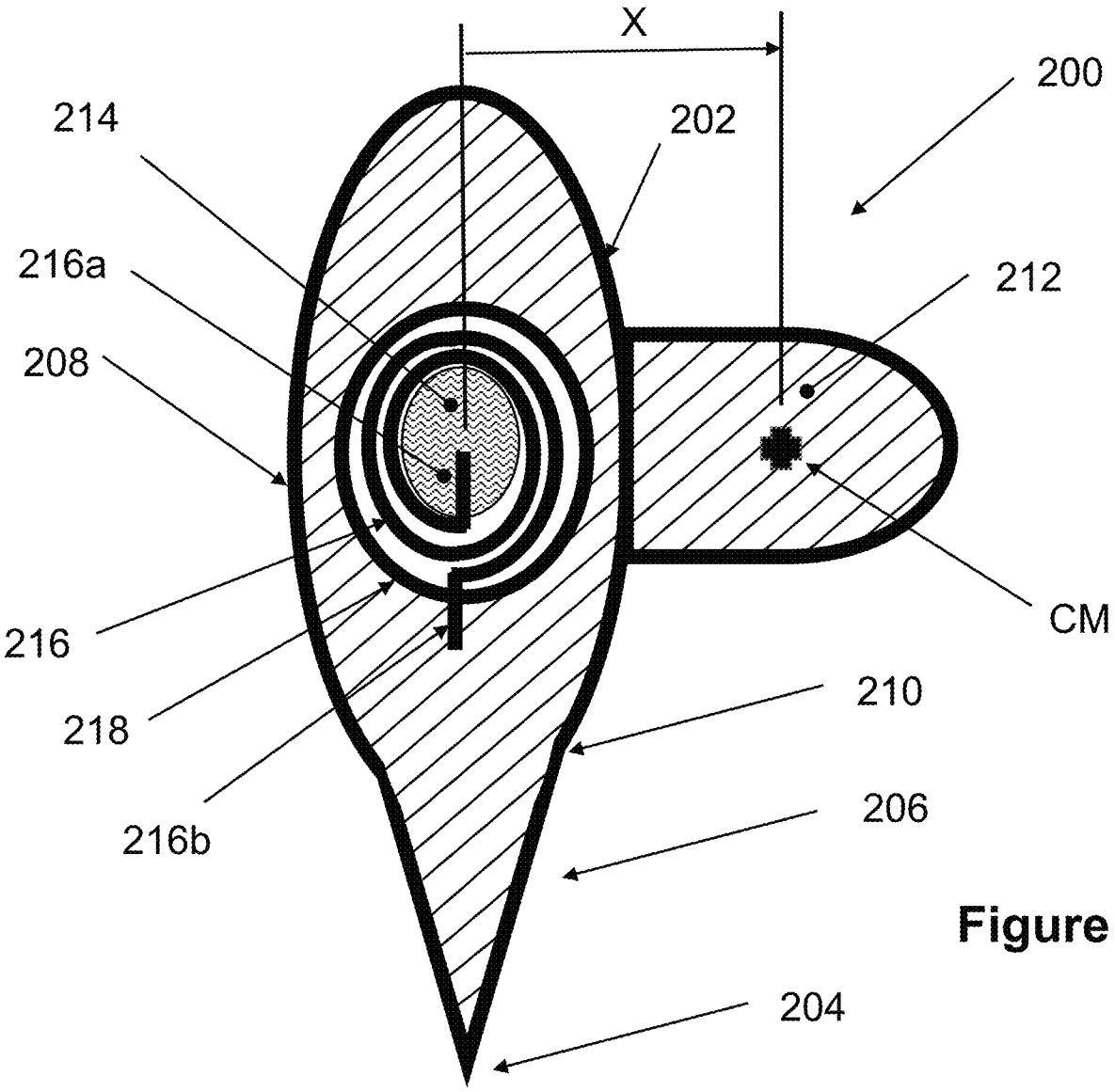
FIG. 2 illustrates a top view of another embodiment of an axe.

Referring now to FIG. 1, there is disclosed a lever axe 100 having an axe head 102 similarly configured as the axe head disclosed in FIG. 2 of U.S. Pat. No. 8,925,207, the entire contents of which is incorporated herein by reference. Such axe head 102 illustrated in FIG. 1 is a simplification of the axe head shown in U.S. Pat. No. 8,925,207, and can include any of the features of such axe head disclosed in U.S. Pat. No. 8,925,207. The axe head 102 of FIG. 1 includes a cutting edge 104 for striking a material to be chopped, such as wood. The lever axe 100 also includes a handle 106 (shown in cross-section) offset from the axe head 102. The handle 106 is disposed in a hole 108 formed by a clamp 110 separately formed with the axe head 102 and retained by threaded ends of the clamp and mating nuts 112. The portions forming the hole 108 can also be integrally formed with the axe head 102.

A spring element, such as a torsion spring 114 is disposed between the axe head 102 and the periphery of the hole 108, such as on the clamp 110. That is, the torsion spring 114 includes a first end 114*a* fixed to the handle and a second end 114*b* fixed to a portion surrounding the hole 108, such as by such ends 114*a*, 114*b* being disposed in corresponding slots or holes formed in the clamp 110 and handle 106. When the axe head 102 is struck against a material, such as a wood log, the torsion spring 114 minimizes a twisting torque on the wrist resulting from the strike of the cutting edge 104 against the chopping material thereby reducing the discomfort and injury to the wrist of the user. The torsion spring 114 also increases an effectiveness of the strike since part of the mechanical energy applied to the chopping material is not absorbed by the user's wrist.

The torsion spring 114 can be pre-loaded and have stops on the handle 106 and on a periphery of the hole 108 to limit a relative rotation between the handle 106 and axe head 102 such that a rotation of the axe head 102 is limited while bringing the axe head down or lifting it up during the strike to make sure that the cutting edge 104 hits the chopped material at a correct angle. The rotational stops can be provided to limit the range of rotation of the axe head 102 relative to the handle 106 (for example +/−30 degrees). The use and configuration of stops to limit a relative rotation between parts is well known in the art.

The torsion spring 114 can be a leaf type, for example, having a flat cross-sectional shape and two or more oppositely directed torsion springs can be used for better (centrally and symmetrically) positioning of the axe head 102 relative to the handle 106. Such oppositely directed torsion springs can be alternated in the longitudinal direction of the handle with each individual torsion spring having ends connected to each of the handle and to the axe head (or portions connected to, or formed with, the axe head, such as the clamp).

Referring now to FIG. 2, there is shown another embodiment of a lever axe 200. Although shown with a similar configuration of torsion spring as FIG. 1, the lever axe 200 of FIG. 2 can be provided with or without such torsion spring arrangement. The lever axe 200 of FIG. 2 includes an axe head 202. The axe head 202 of FIG. 2, like that of FIG. 1 and as is well known in the art, can be formed of metal and treated to be hard and to have a cutting edge 204 able to withstand repeated strikes against a chopping material, such as wood. The axe head 202 may be additionally provided with an axe tip portion 206 that can include a depth penetrating stop that starts and/or increases a splitting moment action of the wood being chopped. In the embodiment of FIG. 2, such depth penetrating stop 210 comprises a transition in the cross-sectional outline of the axe head 202 from the streamlined axe tip portion 206 to a more bulbous head portion 208. However, such depth penetrating portion can be configured in many other ways, such as with a more abrupt transition. Such depth penetrating portion can also be formed integrally with the axe head or separate from the axe head and fixed to such axe head.

The axe head 202 of FIG. 2 further includes an offset mass 212 that shifts a center of mass CM of the axe head 202 away from a center of the handle 214 (offset X). Such offset mass 212 can be attached to a side surface of the axe head or integrally formed therewith. If attached, the same can be adjustable in position and/or interchangeable with different weight/size offset masses to vary the center of mass of the axe head 202 to increase or decrease an amount of splitting torque applied to the wood being cut, for example, based on a type of wood being chopped.

Similar to the configuration described in FIG. 1, a torsion spring 216 is disposed between the axe head 202 and the periphery of a hole 218 in the axe head 202 in which the handle is disposed. That is, the torsion spring 216 includes a first end 216*a* fixed to the handle 214 and a second end 216*b* fixed to a portion of the axe head 202 surrounding the hole 218.

When the axe head 202 strikes the chopping material, such as a log, the sudden deceleration of the axe head 202 as it hits the log generates a large downward inertial torque (acceleration times the mass of the added mass times the offset distance). This is the torque that tends to split the log since the axe head 202 is already some distance wedged into the log and the torque tends to rotate the wedged axe head 202, thereby tending to split the log along the wedged direction (split the portion of the log on one side of the axe head 202 from the portion on the other side of the axe head 202). In the configuration of FIG. 2, the torsion spring 216 significantly reduces the transmission of torque to the users wrist due to the offset mass 212 as the axe head 202 begins to penetrate the log and the transmitted torque due to the reaction of rotation of the torsion spring 216 relative to the handle 214 (which is transmitted to the user's hand/wrist/arm etc.) is no longer a short duration jerking action. That is, the torsion spring 216 minimizes a twisting torque on the wrist resulting from the offset mass 212 when the axe head 202 strikes against the log thereby reducing the discomfort from, and injury to, the wrist of the user. The torsion spring 216 also increases an effectiveness of the strike since part of the mechanical energy applied to the log is not absorbed by the user's wrist.

As discussed above with regard to FIG. 1, the torsion spring 216 of FIG. 2 can be pre-loaded and have stops on the handle 214 and on a periphery of the hole in the axe head 202 to limit a relative rotation between the handle 214 and axe head 202 such that a rotation of the axe head 202 is limited while bringing the axe head 292 down or lifting it up during the strike to make sure that the cutting edge 204 hits the material at a correct angle. The rotational stops can be provided to limit the range of rotation of the axe head 202 relative to the handle 214 (for example +/−30 degrees) and the torsion spring 216 can be a leaf type, for example, having a flat cross-sectional shape and two or more oppositely directed torsion springs can be used for better (centrally and symmetrically) positioning of the axe head 202 relative to the handle 214.

Figure 3:
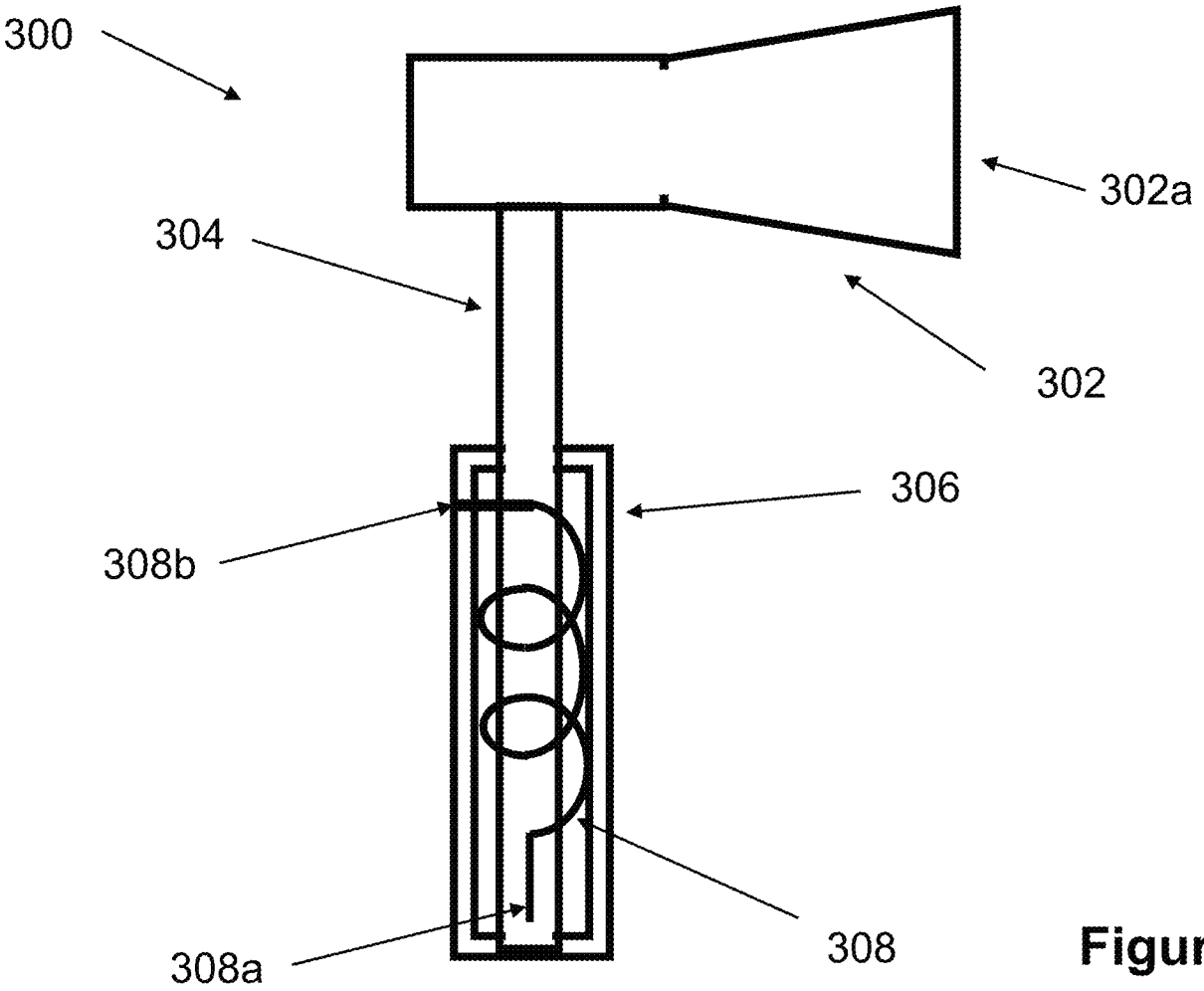
FIG. 3 illustrates a side view of another embodiment of an axe, which can be combined with the embodiments of FIG. 1 or 2.

Referring now to FIG. 3, there is shown another embodiment of an axe 300 which can be used with a lever type axe head, such as the axe head 102 in FIG. 1 or axe head 202 of FIG. 2. The handle configuration of FIG. 3, as discussed below, can be used together with the torsion spring arrangements discussed above with regard to FIGS. 1 and 2 or separately therefrom. In FIG. 3, the axe 300 includes an axe head 302 configured as a lever type axe head for producing a moment to split, for example, a log being chopped. As discussed above, such lever type axe heads can be those discussed above with regard to the prior art or in FIGS. 1 and 2.

The axe 300 also includes a handle 304 which, in the case of the lever axe heads 102, 202 discussed above, can be separately formed from the axe head 302, or in the case of a lever type axe head not provided with a spring element arrangement, such as the torsion spring arrangement of FIGS. 1 and 2, the handle 304 can be separately or integrally formed with the axe head 302.

A handle jacket 306 is formed to rotationally move relative to the handle 304 and includes a grip or the like to be gripped by the user during use. A spring element, such as a torsion spring 308 is provided having a first end 308*a* fixed to the handle 304 and a second end 308*b* fixed to the handle jacket 306.

As discussed above with regard to FIGS. 1 and 2, the torsion spring 308 of FIG. 3 can be pre-loaded and have stops on the handle 304 and on the handle jacket 306 to limit a relative rotation between the handle 304 and handle jacket 306 such that a rotation of the handle 304 (and axe head 302 connected thereto) is limited while bringing the axe down or lifting it up during the strike to make sure that a cutting edge 302*a* of the axe head 302 hits the chopped material at a correct angle. The rotational stops discussed above can be provided to limit the range of rotation of the handle 304 relative to the handle jacket 306 (for example +/−10-20 degrees), the torsion spring 308 can be a leaf type, for example, having a flat cross-sectional shape and two oppositely directed torsion springs can be used for better (centrally and symmetrically) positioning of the axe head 302 relative to the handle jacket 306.

In the configuration of FIG. 3, the torsion spring 308 significantly reduces the transmission of torque to the users wrist due to the lever type axe head 302 as the same begins to penetrate the log and the transmitted torque due to the reaction of rotation of the torsion spring 308 relative to the handle 304 (which is transmitted to the user's hand/wrist/arm etc.) is no longer a short duration jerking action. That is, the torsion spring 308 minimizes a twisting torque on the wrist resulting from the axe head 302 when the axe head 302 strikes against the log thereby reducing the discomfort and injury to the wrist of the user. The torsion spring 308 also increases an effectiveness of the strike since part of the mechanical energy applied to the log is not absorbed by the user's wrist.

Furthermore, an outer surface of the handle jacket 306 can be padded to minimize transfer of torque. Still further, the applied torque pulse transmission to the user wrist can be damped using rubber dampers or similar elements.

Figure 4:
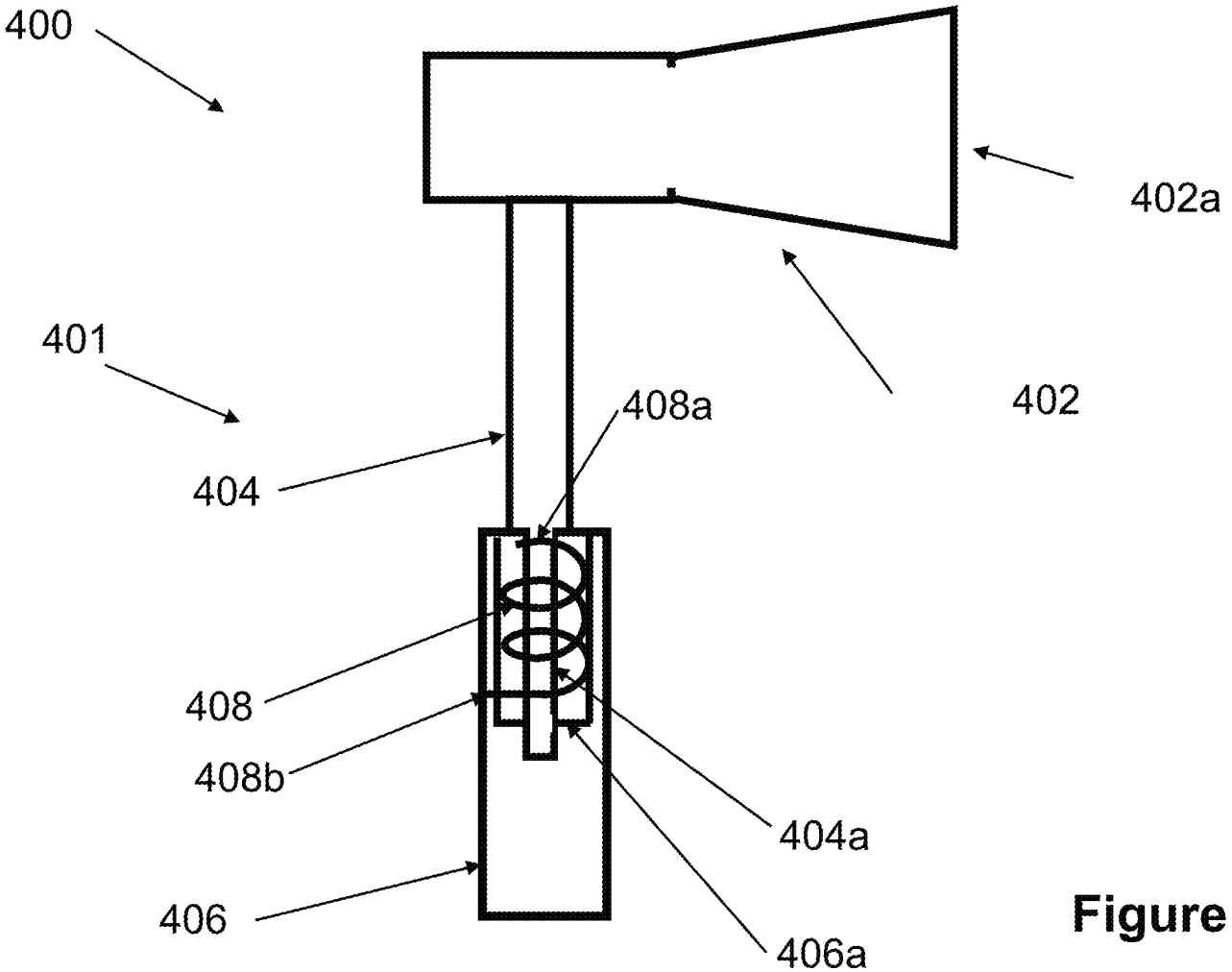
FIG. 4 illustrates a side view of yet another embodiment of an axe, which can be combined with the embodiments of FIG. 1 or 2.

Referring now to FIG. 4, there is shown another embodiment of axe 400 which can be used with a lever type axe head, such as the axe head 102 in FIG. 1 or axe head 202 of FIG. 2. The handle configuration of FIG. 4, as discussed below, can be used together with the torsion spring arrangements discussed above with regard to FIGS. 1 and 2 or separately therefrom. In FIG. 4, the axe 400 includes an axe head 402 configured as a lever type axe head for producing a moment to split, for example, a log being chopped. As discussed above, such lever type axe head can be those discussed above with regard to the prior art or in FIGS. 1 and 2.

The axe 400 also includes a handle 401 comprising first and second handle parts 404, 406, respectively. In the case of the lever axe heads 102, 202 discussed above, the first handle part 404 can be separately formed from the axe head 402, or in the case of a lever type axe head not provided with a spring element arrangement, such as the torsion spring arrangement of FIGS. 1 and 2, the first handle part 404 can be separately or integrally formed with the axe head 402.

The second handle part 406 is formed to rotationally move relative to the first handle part 404 and includes a grip or the like to be gripped by the user during use. A spring element, such as a torsion spring 408 is provided having a first end 408*a* fixed to the first handle part 404 and a second end 408*b* fixed to the second handle part 406. The first and second handle parts 404, 406 are captured to rotate relative with each other while staying connected to each other, by any capturing means known in the art, such as a slot and retaining ring arrangement.

The torsion spring 408 can be disposed between a transition between the first and second handle parts 404, 406, in which case a riding sleeve can be provided covering at least such transition so that the handle 401 does not bend or fail at the transition. Alternatively, as shown in FIG. 4, one of the first or second handle parts 4040, 406 can have an extension 404*a* and the other a bore 406*a* for accommodating the extension 404*a* where one of the first and second ends 408*a*, 408*b* of the torsion spring 408 is attached to the extension 404*a* and the other of the first and second ends 408*a*, 408*b* of the torsion spring 408 is attached to a periphery of the bore 406*a*. In the configuration shown in FIG. 4, the first handle part 404 has the extension 404*a* and the second handle part 406 has the bore 406*a* where the first end 408*a* of the torsion spring 408 is attached to the extension 404*a* and the second end 408*b* of the torsion spring 408 is attached to the second handle part 406.

As discussed above with regard to the above embodiments, the torsion spring 408 of FIG. 4 can be pre-loaded and have stops on the handle extension 404*a* and on the second handle part 406 to limit a relative rotation between the first and second handle parts 404, 406 such that a rotation of the first handle part 404 (and axe head 402 connected thereto) is limited while bringing the axe down or lifting it up during the strike to make sure that a cutting edge 402*a* of the axe head 402 hits the material at a correct angle. The rotational stops can be provided to limit the range of rotation of the first handle part 404 relative to the second handle part 406 (for example +/−10-20 degrees) and the torsion spring 408 can be a leaf type, for example, having a flat cross-sectional shape and two or more oppositely directed torsion springs can be used for better (centrally and symmetrically) positioning of the axe head 402 relative to the second handle part 406.

In the configuration of FIG. 4, the torsion spring 408 significantly reduces the transmission of torque to the users wrist due to the lever type axe head 402 as the same begins to penetrate the log and the transmitted torque due to the reaction of rotation of the torsion spring 408 relative to the first handle part 404 (which is transmitted to the user's hand/wrist/arm etc.) is no longer a short duration jerking action. That is, the torsion spring 408 minimizes a twisting torque on the wrist resulting from the axe head 402 when the axe head 402 strikes against the log thereby reducing the discomfort and injury to the wrist of the user. The torsion spring 408 also increases an effectiveness of the strike since part of the mechanical energy applied to the log is not absorbed by the user's wrist.

Furthermore, an outer surface of the second handle part 406 can be padded to minimize transfer of torque. Still further, the applied torque pulse transmission to the user's wrist can be damped using rubber dampers or similar elements.

The above exemplary configurations use a torsion spring as the spring element, however, any spring element which permits a relative rotation and is resilient (having a return action) can be used as the spring element. Such spring elements are collectively defined as a spring herein. For example, the spring can comprise an elastomer filling a gap between the relative moving parts (e.g., between the periphery of the hole and handle in FIGS. 1 and 2, between the handle and handle jacket in FIG. 3 and between the first handle extension and an inner periphery of the bore of the second handle part in FIG. 4). Such elastomer would permit the relative movement to a degree that is a function of a hardness of such elastomer and would provide the necessary spring return that is inherent in the resiliency of such elastomers. The corresponding surfaces having the elastomer can be treated and/or formed (e.g., machined) to facilitate adhesion of the elastomer to such surfaces.

Figure 5:
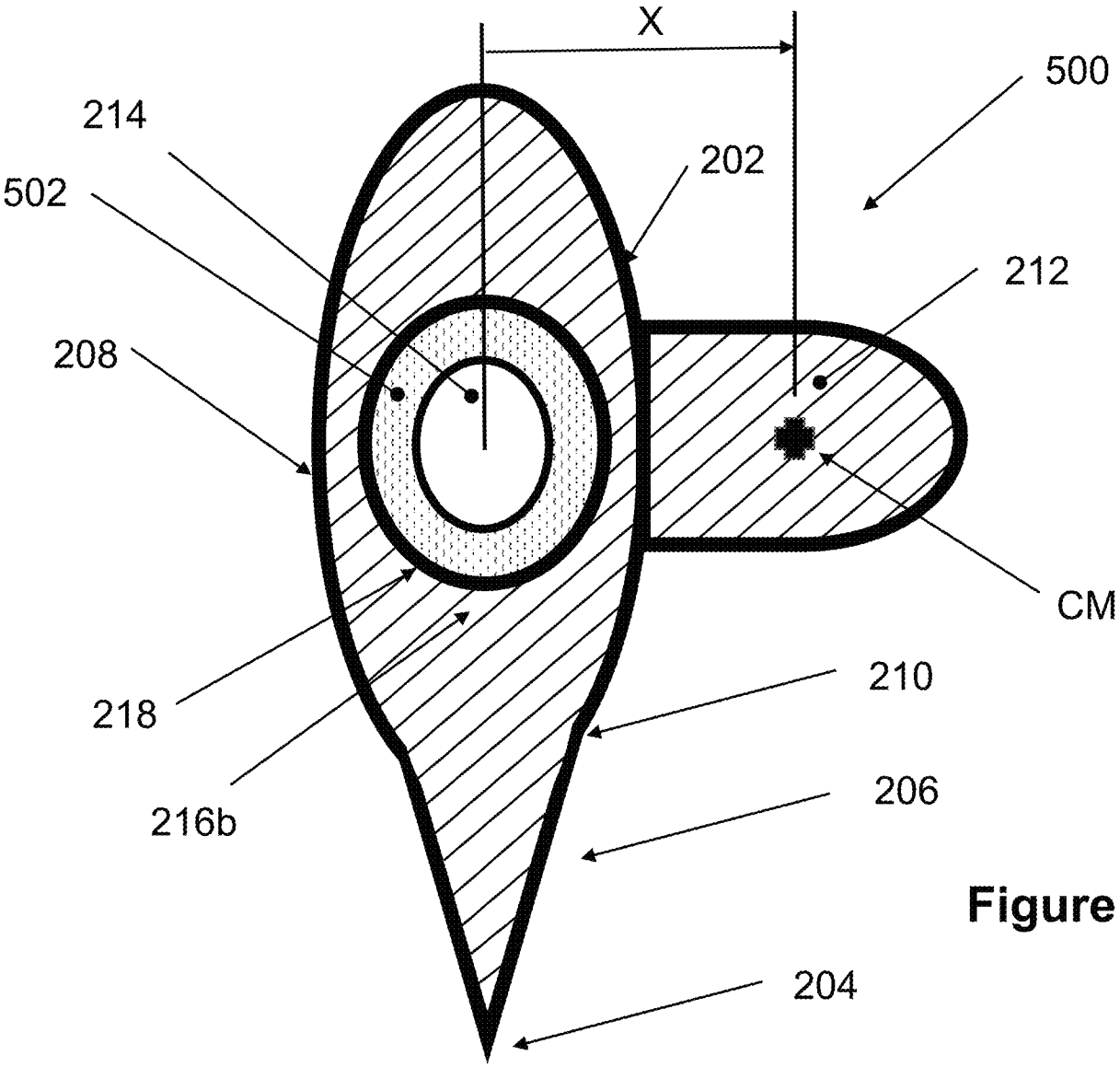
FIG. 5 illustrates a top view of an alternative embodiment of the axe of FIG. 2.
Figure 6:
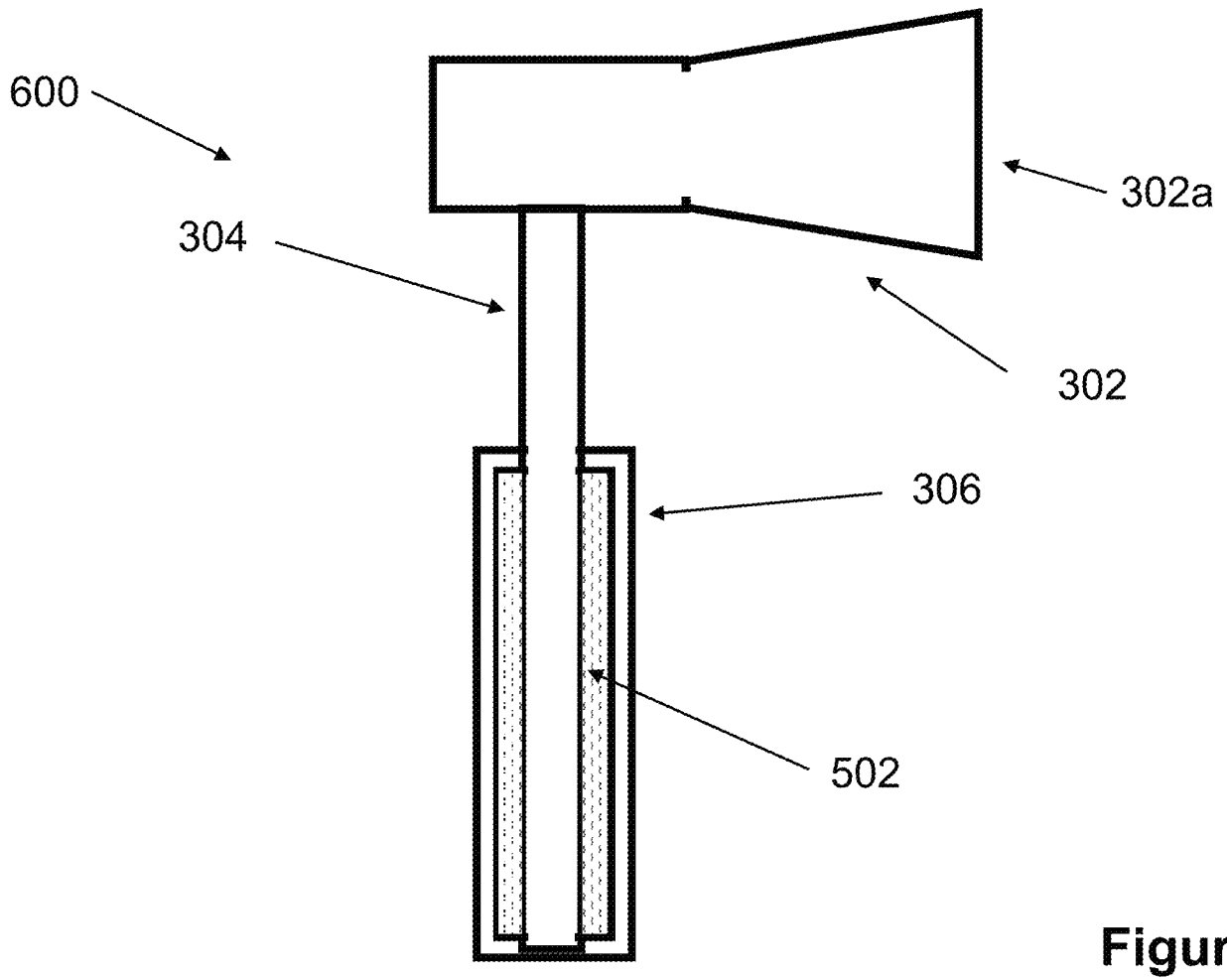
FIG. 6 illustrates a side view of an alternative embodiment of the axe of FIG. 3.
Figure 7:
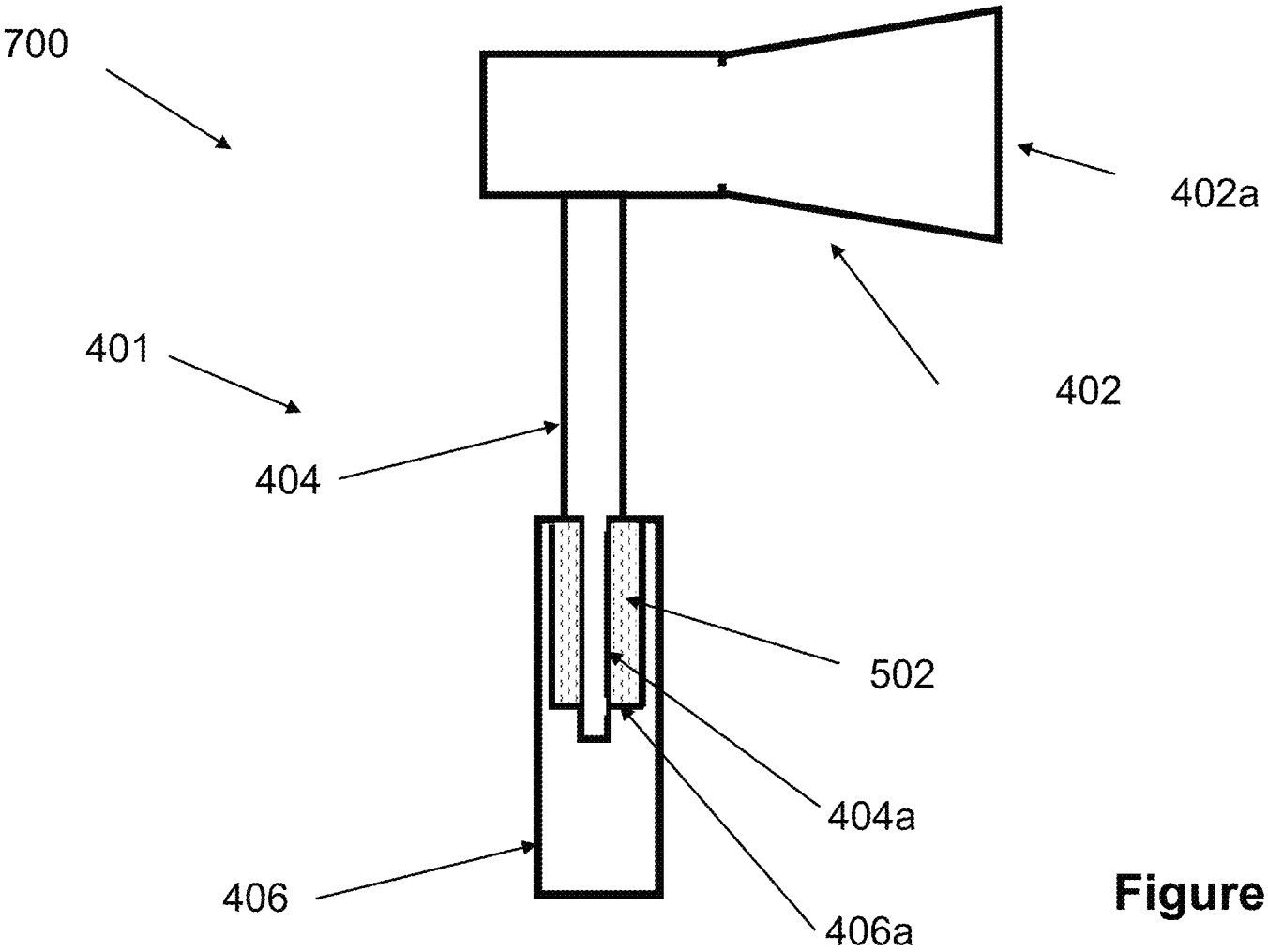
FIG. 7 illustrates a side view of an alternative embodiment of the axe of FIG. 4.

As shown in FIG. 5, in which like reference numerals refer to like features, an axe 500 is shown having an elastomer 502, such as a natural or synthetic rubber, disposed between the periphery of the hole 218 and the handle 214. The axe 100 of FIG. 1 can be similarly configured as the axe 500 in FIG. 5. As shown in FIG. 6, in which like reference numerals refer to like features, an axe 600 is shown having the elastomer 502 disposed between the handle 304 and handle jacket 306. As shown in FIG. 7, in which like reference numerals refer to like features, an axe 700 is shown having the elastomer 502 disposed between the first handle extension 404*a* and an inner periphery of the bore 406*a* of the second handle part 406.

Figure 8:
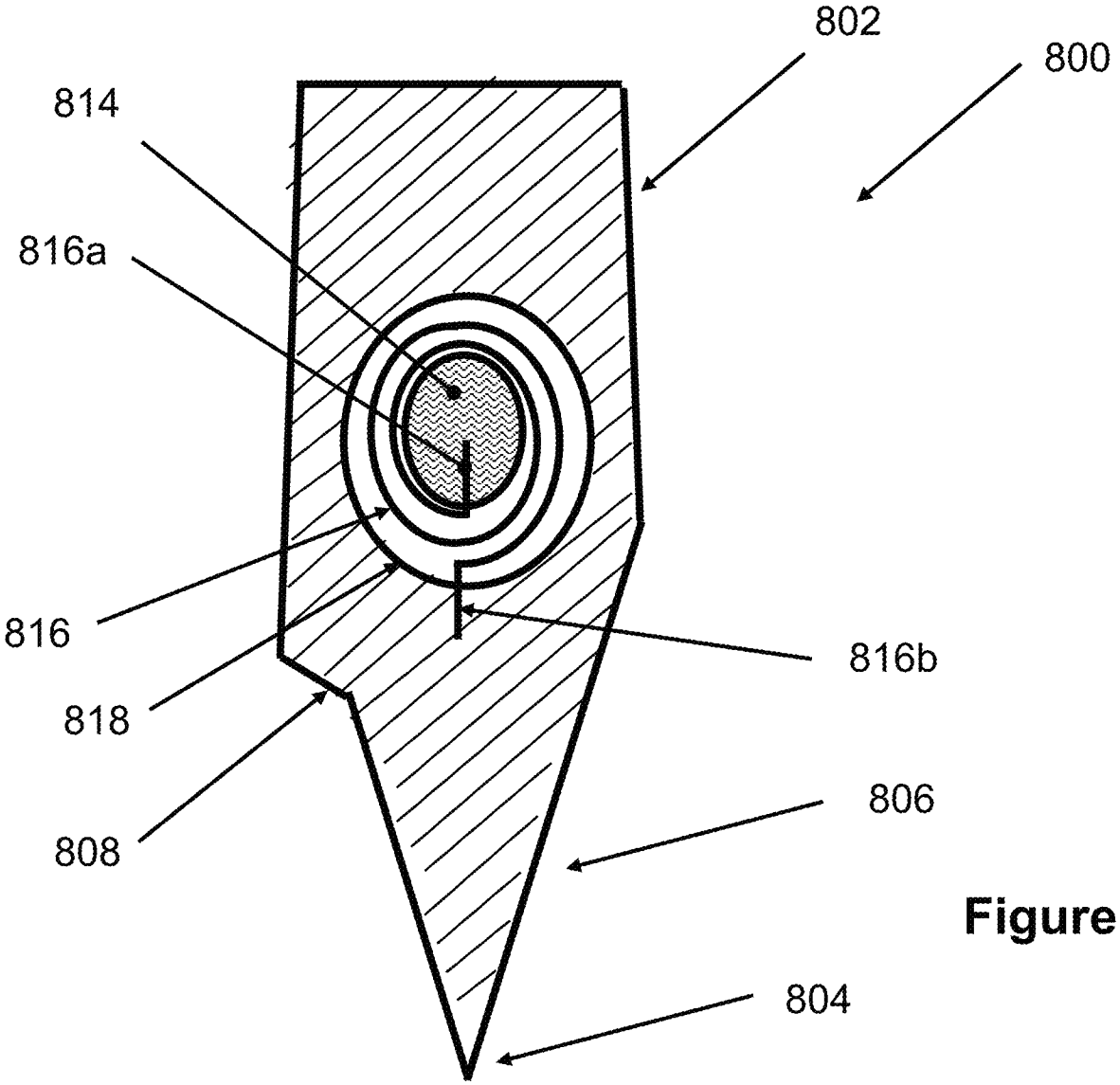
FIG. 8 illustrates a top view of another embodiment of axe.

Referring now to FIG. 8, there is shown another embodiment of a lever axe 800. Although shown with a similar configuration of torsion spring as discussed above with regard to FIGS. 1 and 2, the lever axe 800 of FIG. 8 can be provided with or without such torsion spring arrangement. The lever axe 800 of FIG. 8 includes an axe head 802. The axe head 802 of FIG. 8, as is well known in the art, can be formed of metal and treated to be hard and to have a cutting edge 804 able to withstand repeated strikes against a chopping material, such as wood.

A torsion spring 816 is disposed between the axe head 802 and the periphery of a hole 818 in the axe head 802 in which the handle is disposed. That is, the torsion spring 816 includes a first end 816*a* fixed to the handle 814 and a second end 816*b* fixed to a portion of the axe head 802 surrounding the hole 818.

The axe head 802 is additionally provided with an axe tip portion 806 that includes a depth penetrating stop 808 disposed on one side thereof that tends to rotate the axe head 802 to start a splitting moment action of the wood being chopped. In the embodiment of FIG. 8, such depth penetrating stop 808 comprises an abrupt transition in the cross-sectional outline of the axe head 802 from the streamlined axe tip portion 806 with the remaining portion of the axe head 802. Such depth penetrating stop 808 can be configured in many other ways, such as a projection projecting from an otherwise symmetrically formed axe head. Furthermore, the depth penetrating stop 808 can be formed integrally with the axe head 802 or separate from the axe head and fixed to such axe head, in which case the size, abruptness and/or location of the depth penetrating stop 808 can be varied.

When the axe head 802 strikes the chopping material, such as a log, the sudden deceleration of the axe head 802 as the depth penetrating stop 808 hits the log generates a large downward inertial torque (acceleration times the mass of the added mass times the offset distance). This is the torque that tends to split the log since the axe head 802 is already some distance wedged into the log and the torque tends to rotate the wedged axe head 802, thereby tending to split the log along the wedged direction (split the portion of the log on the side of the axe head 802 having the not depth penetrating stop 808 from the portion on the side of the axe head 802 having the depth penetrating stop 808). In the configuration of FIG. 8, the torsion spring 816 significantly reduces the transmission of torque to the users wrist due to the depth penetrating stop 808 as the axe head 802 begins to penetrate the log and the transmitted torque due to the reaction of rotation of the torsion spring 816 relative to the handle 814 (which is transmitted to the user's hand/wrist/arm etc.) is no longer a short duration jerking action. That is, the torsion spring 816 minimizes a twisting torque on the wrist resulting from the depth penetrating stop 808 when the axe head 802 strikes against the log thereby reducing the discomfort and injury to the wrist of the user. The torsion spring 816 also increases an effectiveness of the strike since part of the mechanical energy applied to the log is not absorbed by the user's wrist.

Figure 9:
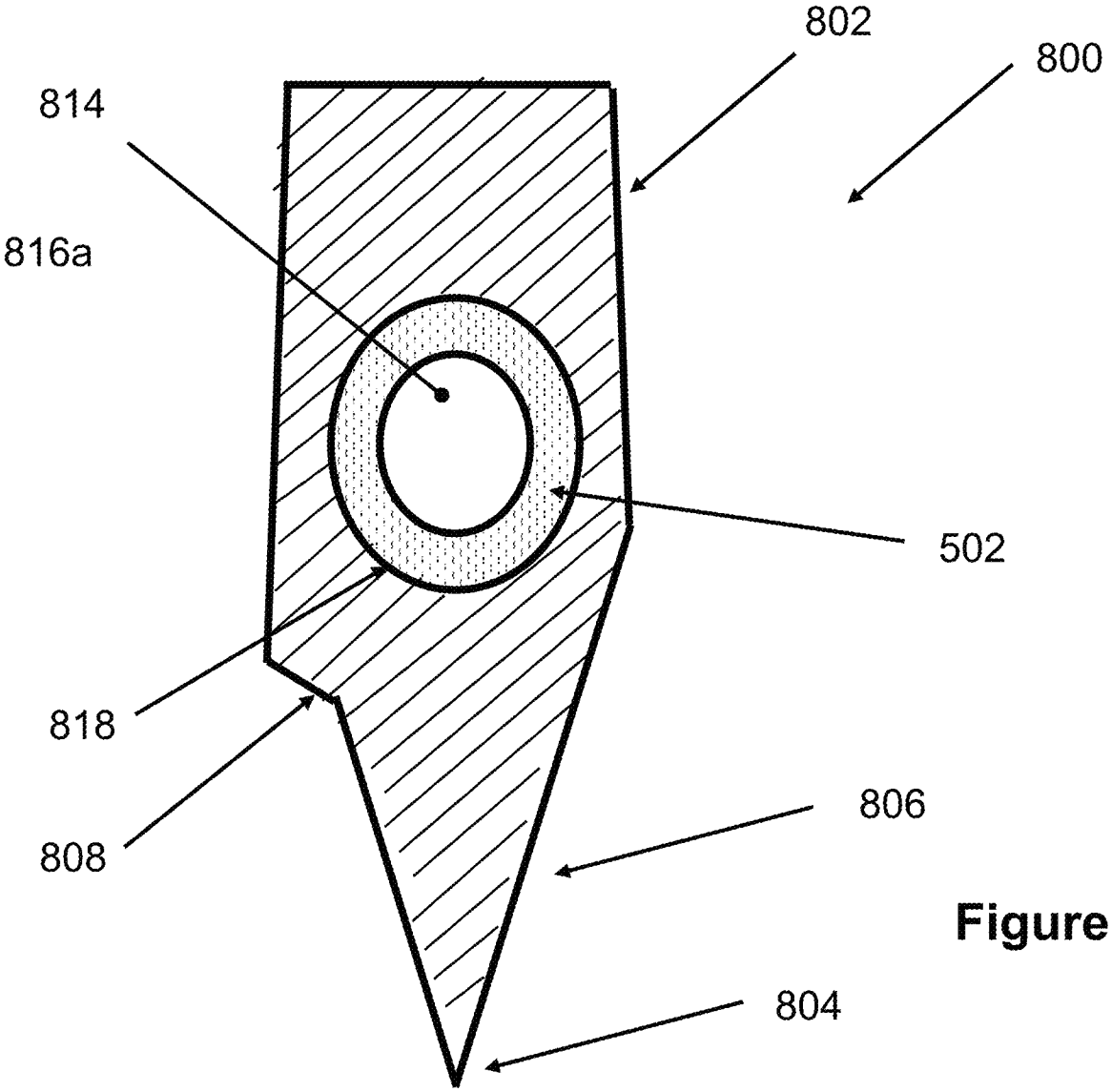
FIG. 9 illustrates a top view of an alternative embodiment of the axe of FIG. 8.

The axe 800 in FIG. 8 can be used together with the embodiments shown in FIGS. 3, 4, 6 and 7 and can be alternatively provided with the elastomer 502 as shown in FIG. 9.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An axe comprising:

a lever axe head having a cutting edge, the lever axe head being configured to generate a torque and to rotate upon one of the cutting edge striking a material and the cutting edge penetrating a predetermined distance into the material;

a handle having a first portion attached to the lever axe head and a second portion to be gripped by a user; and one or more springs disposed between the first portion of the handle and the lever axe head for biasing the lever axe head and handle relative to each other such that first portion of the handle and the lever axe head rotate relative to each other to absorb at least a portion of the generated torque from being transmitted to the user.

2. The axe of claim 1, wherein the handle having a single piece construction and the first portion of the handle comprises a first end of the handle.

3. The axe of claim 1, wherein the handle comprising a first handle having the first portion and a handle jacket having the second portion, the handle jacket being rotatably disposed relative to the first handle and the handle jacket being disposed over an outer surface of the first handle.

4. The axe of claim 1, wherein the handle comprising a first handle having the first portion and a second handle having the second portion, the second handle being rotatably disposed relative to the first handle and the first and second handles being arranged in series from the lever axe head.

5. The axe of claim 1, wherein the lever axe head being provided offset from the handle to generate the torque.

6. The axe of claim 1, wherein the lever axe head being provided with an offset mass for offsetting a center of mass from the handle to generate the torque.

7. The axe of claim 1, wherein the lever axe head being provided with a depth penetrating stop asymmetrically formed relative to the handle to generate the torque.

8. The axe of claim 1, wherein the lever axe head being provided with a depth penetrating stop symmetrically formed relative to the handle.

9. The axe of claim 1, wherein the one or more springs comprises a torsion spring having a first end fixed to the first portion of the handle and a second end at least indirectly fixed to the lever axe head.

10. The axe of claim 1, wherein the one or more springs comprises an elastomer disposed in a space between the first portion of the handle and the lever axe head such that the elastomer is fixed to the first portion of the handle and at least indirectly fixed to the lever axe head.

11. An axe comprising:

a lever axe head having a cutting edge, the lever axe head being configured to generate a torque and to rotate upon one of the cutting edge striking a material and the cutting edge penetrating a predetermined distance into the material; and a handle having a first portion attached to the lever axe head and a second portion to be gripped by a user;

wherein the lever axe head being provided with an offset mass for offsetting a center of mass from the handle to generate the torque; and the axe further comprising one or more springs disposed between the first portion of the handle and the lever axe head for biasing the lever axe head and handle relative to each other such that first portion of the handle and the lever axe head rotate relative to each other to absorb at least a portion of the generated torque from being transmitted to the user.

12. The axe of claim 11, wherein the handle having a single piece construction and the first portion of the handle comprises a first end of the handle.

13. The axe of claim 11, wherein the handle comprising a first handle having the first portion and a handle jacket having the second portion, the handle jacket being rotatably disposed relative to the first handle and the handle jacket being disposed over an outer surface of the first handle.

14. The axe of claim 11, wherein the handle comprising a first handle having the first portion and a second handle having the second portion, the second handle being rotatably disposed relative to the first handle and the first and second handles being arranged in series from the lever axe head.

15. An axe comprising:

a lever axe head having a cutting edge, the lever axe head being configured to generate a torque and to rotate upon one of the cutting edge striking a material and the cutting edge penetrating a predetermined distance into the material; and a handle having a first portion attached to the lever axe head and a second portion to be gripped by a user;

wherein the lever axe head being provided with a depth penetrating stop asymmetrically formed relative to the handle to generate the torque; and the axe further comprising one or more springs disposed between the first portion of the handle and the lever axe head for biasing the lever axe head and handle relative to each other such that first portion of the handle and the lever axe head rotate relative to each other to absorb at least a portion of the generated torque from being transmitted to the user.

16. The axe of claim 15, wherein the handle having a single piece construction and the first portion of the handle comprises a first end of the handle.

17. The axe of claim 15, wherein the handle comprising a first handle having the first portion and a handle jacket having the second portion, the handle jacket being rotatably disposed relative to the first handle and the handle jacket being disposed over an outer surface of the first handle.

18. The axe of claim 15, wherein the handle comprising a first handle having the first portion and a second handle having the second portion, the second handle being rotatably disposed relative to the first handle and the first and second handles being arranged in series from the lever axe head.

* * * * *